US009776758B2

(12) United States Patent
Rentzel et al.

(10) Patent No.: US 9,776,758 B2
(45) Date of Patent: Oct. 3, 2017

(54) STACKING BOX AND SYSTEM

(75) Inventors: Michael Rentzel, York, PA (US); Josh Gordon, Columbia, PA (US); Charles Kelley, Red Lion, PA (US)

(73) Assignee: Innovative Packaging Solutions, Lancaster, PA (US)

( * ) Notice: Subject to any disclaimer, the term of this patent is extended or adjusted under 35 U.S.C. 154(b) by 941 days.

(21) Appl. No.: 13/402,304

(22) Filed: Feb. 22, 2012

(65) Prior Publication Data

US 2013/0213842 A1 Aug. 22, 2013

(51) Int. Cl.
*B65D 85/00* (2006.01)
*B65D 5/42* (2006.01)
*B65D 85/04* (2006.01)

(52) U.S. Cl.
CPC ..... *B65D 5/427* (2013.01); *B65D 85/04* (2013.01)

(58) Field of Classification Search
CPC ..... B65D 85/04; B65D 2571/0066; B65D 2571/00185; B65H 49/14; B65H 49/16
USPC ..... 206/395, 409, 509, 511–512, 504; 220/62, 23.4; 229/12.01, 120.011
See application file for complete search history.

(56) References Cited

U.S. PATENT DOCUMENTS 2,913,162 A * 11/1959 Goltz ..... 206/509
6,016,911 A * 1/2000 Chen ..... 206/395
2003/0001003 A1* 1/2003 Rowland ..... 229/120.01

* cited by examiner

*Primary Examiner* — Anthony Stashick
*Assistant Examiner* — James M Van Buskirk
(74) *Attorney, Agent, or Firm* — Maginot, Moore & Beck LLP

(57) ABSTRACT

A container system includes a first corrugated paper container and a second corrugated paper container. The first corrugated paper container has a slot formed in a first side thereof. The second corrugated paper container is disposed adjacent to the first corrugated paper container. The second corrugated paper container has a retaining tab formed from a side of the second corrugated paper container. The retaining tab extends into the slot of the first container so as to couple the first corrugated paper container to the second corrugated paper container.

8 Claims, 4 Drawing Sheets

STACKING BOX AND SYSTEM

FIELD OF THE INVENTION

The present invention relates to boxes, and more specifically, to boxes formed from paper board.

BACKGROUND

Boxes formed from corrugated paper are used for a variety of storage and transport purposes. A typical corrugated paper box is formed from a corrugated paper blank that is folded into the box form. The blanks can be configured to into open-top boxes, such as so-called "banker boxes", which have separate lids, or closed-top boxes, such as those used for moving and storage of household items. The advantages of corrugated paper boxes include a favorable strength to weight ratio, the ease of manufacturing and construction, and the ease of transport in the unassembled form.

Another advantage of corrugated paper boxes is that they may, at least in some degree, be adapted to special uses. One such special use is for the payout of cabling in construction and renovation sites. In particular, it is known in the electrical industry to store and move wound or coiled cable in a corrugated paper box. At the installation site, the cable (or other wound material) is fed through an opening in the box. The installer thereafter pulls the wound material through the opening for pay out and installation. As the material is pulled through, the coil of material rotates within the box, either as a standalone coil, or on a specially made axle mounted in the box.

A drawback to the use of corrugated paper boxes for pay out of cabling at installation site is the coordination of multiple boxes for multiple cables to be installed in the same area. For example, there exist installation circumstances in which as many as six to ten cables may be installed as a bundle within a space of a facility. It is known to stack multiple cable pay out boxes to allow for simultaneous payout of several cables. However, due to the friction forces present in the payout process, the cable pulling process can lead to movement and falling of boxes from the stack.

There is a need, therefore, for a system and associated box design that allows for payout of multiple cables simultaneously without the aforementioned drawbacks.

SUMMARY

Embodiments of the present invention address the above-described need, as well as others, by providing a corrugated paper container configured to interconnect with other corrugated paper containers using integrally formed features of the corrugated paper containers.

A first embodiment is a container system that includes a first corrugated paper container and a second corrugated paper container. The first corrugated paper container has a slot formed in a first side thereof. The second corrugated paper container is disposed vertically adjacent to the first corrugated paper container. The second corrugated paper container has a retaining tab formed from a side of the second corrugated paper container. The retaining tab extends into the slot of the first container so as to couple the first corrugated paper container to the second corrugated paper container.

A second embodiment is a corrugated paper container that includes a plurality of sides integrally formed from a corrugated paper blank. The container includes a retaining tab and a slot. The retaining tab is formed from a first side such that the first side includes a void having a shape substantially the same as a shape of the retaining tab. The slot is aligned with and spaced from the retaining tab, the slot configured to receive a corresponding retaining tab of another corrugated paper container.

The above-described features and advantages, as well as others, will become more readily apparent to those of ordinary skill in the art by reference to the following detailed descriptions and accompanying drawings.

DETAILED DESCRIPTION

Figure 1:
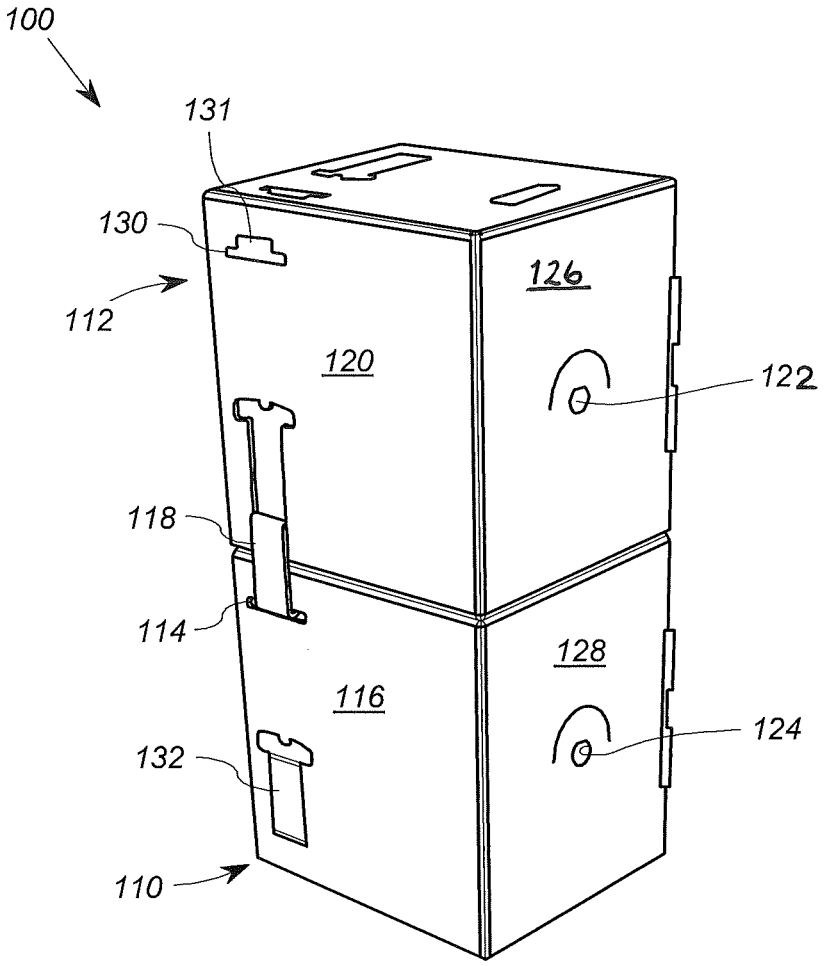
FIG. 1 shows a perspective view a set of stacked corrugated paper containers according to a first embodiment of the invention.

FIG. 1 shows a container system 100 having a first corrugated paper container 110 and a second corrugated paper container 112 disposed vertically adjacent to the first corrugated paper container 110. The first corrugated paper container 110 includes a slot 114 formed in a first side 116 of the corrugated paper container 110. The second corrugated paper container 112 includes a retaining tab 118 formed from a side 120 of the second corrugated paper container 112. The retaining tab 118 extends into the slot 114 of the first corrugated paper container 110 so as to couple the first corrugated paper container 110 to the second corrugated paper container 112.

Each of the corrugated paper containers 110, 112 is configured to contain wound or coiled media, not shown in FIG. 1, such as cabling, configured internally in any conventional manner. The media may comprise electrical cabling, hose, rope, or any other media capable of being wound, coiled or otherwise bunched within the corrugated paper containers 110, 112 in any conventional manner.

The first corrugated paper container 110 includes a void or opening 124 on a second side 128 through which the media may be fed. Similarly, the second corrugated paper container 112 includes a void or opening 122 on a second side 126 through which the media may be fed.

As will be discussed below in detail, the retention of the retaining tab 118 within the slot 114 helps retain the second corrugated paper container 112 in position atop the first corrugated paper container 110. The system 100 is scalable to accommodate additional stacked containers, not shown. To this end, the second corrugated container 112 includes a slot 130 configured to receive a retaining tab of another container, not shown, that may be stacked atop the second corrugated paper container 112. In FIG. 1, the slot 130 is occupied by a member 131 that may be manually folded inward or outward out of the slot 130 to allow for use of the slot.

Similarly, the first corrugated paper container 110 includes its own retaining tab 132 which may be inserted into a corresponding slot, not shown, of another container, not shown, disposed below the first corrugated paper container 110. The retaining tab 132 is integrally formed with the side 116 of the first container 110.

Figure 2A:
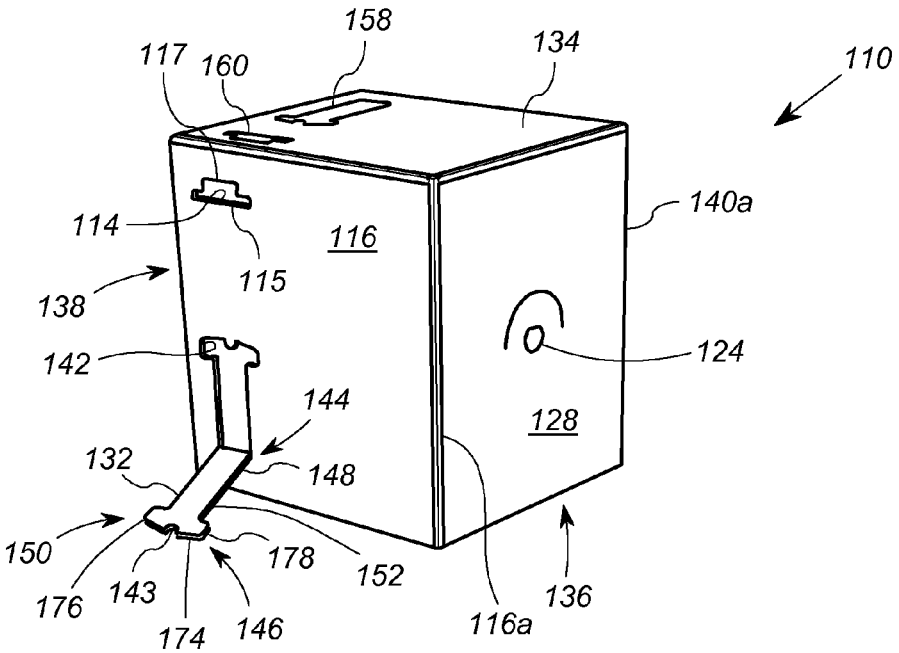
FIG. 2 shows perspective view of a corrugated paper container according to a first embodiment of the invention.
Figure 2B:
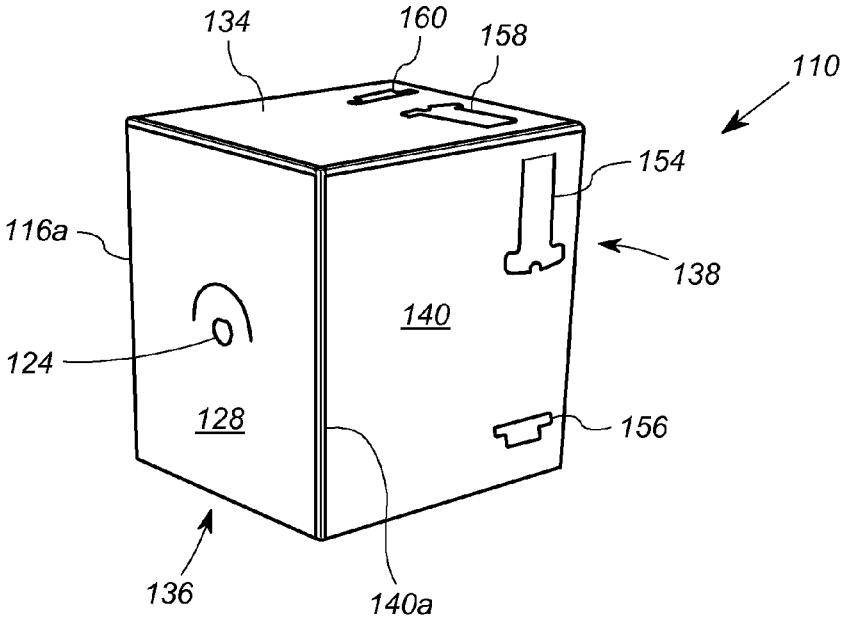
Figure 3:
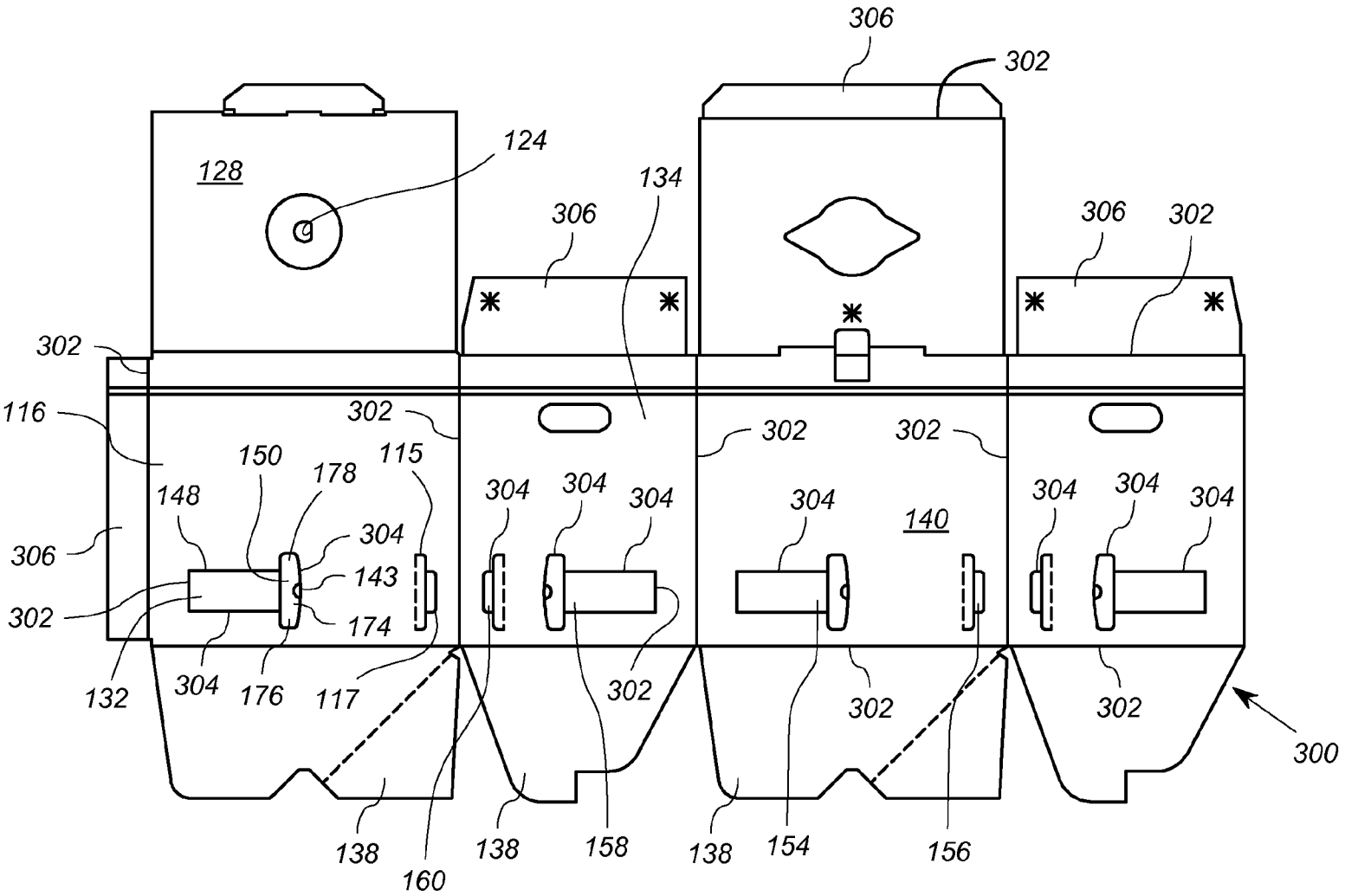
FIG. 3 shows a plan view of a corrugated paper sheet configured to form the corrugated paper container of FIG. 1.

FIGS. 2*a* and 2*b* show different perspective views of the first corrugated paper container 110 apart from the system 100 of FIG. 1. The corrugated paper container 110 includes a plurality of sides 116, 128, 134, 136, 138, 140 integrally formed from a corrugated paper blank. FIG. 3, discussed further below, show a corrugated paper blank 300 configured for assembly into the corrugated paper container 110. In addition to the first side 116 and second side 128 discussed above in connection with FIG. 1, the corrugated paper container 110 includes a third side 134 shown as the top in FIGS. 2A and 2B, and fourth, fifth and sixth sides 136, 138 and 140. In FIGS. 2A and 2B, the fourth side 136 and fifth side 138 are hidden from view. FIG. 2B shows the sixth side 140.

As shown in FIG. 2, the retaining tab 132 is formed from the first side 116 such that the first side 116 includes a void 142 having approximately the shape of the retaining tab 132. However, as will be discussed below, the retaining tab 132 includes a small additional access cutout 143 to allow for removal of the retaining tab 132 from the void 142.

In any event, the retaining tab 132 has a first end 144 integrally coupled to (i.e. formed as a continuous part of) the first side 116 and a second end 146. The retaining tab 132 in this embodiment comprises a body portion 148 and a head portion 150. The body portion 148 includes a first end defined by the first end 144 of the retaining tab 132, and a second end 152 at which is coupled the head portion 150. The head portion 150 has a central portion 174 disposed between a set of wings or tabs 176, 178. The central portion 174 of the head portion 150 is defined by the width of the body portion 148. The tabs 176, 178 extend outward from the central portion 174 such that the width of the head portion 150 exceeds that of the body portion 148.

The retaining tab 132 may suitably be formed by providing a first set of perforations defining the periphery of the retaining tab 132, other than the first end 144 which remains attached to the first side 116. Further details regarding such perforations are discussed below in connection with FIG. 3. In any event, the retaining tab 132 may be pulled out of the void 142, or in other words, the perforations broken, to extend the tab 132 outward from the first side 116 as shown in FIG. 2.

It will be appreciated that when the retaining tabs such as the tab 132 are stated to be "extending from", it shall be without regard to whether the subject retaining tab has been pulled out of the side from which it was formed. Thus for example, the retaining tab 132 extends from the first side 116 in both of FIGS. 1, 2A, regardless of whether it has been removed from the void 142. However, in FIG. 2A, the retaining tab 132 also extends outward from the first side 116.

As discussed above, the head portion 150 has a width that exceeds a width of the body portion 148. However, as will be discussed below in detail, the head portion 150 need only be wider than a part (proximate the second end 152) of the body portion 148 that is adjacent to the head portion 150 to aid in the retention of the head portion 150 in the slot of another stacked container, not shown.

As shown in FIG. 2, the slot 114 is aligned with and vertically spaced from the retaining tab 132. The slot 114 is configured to receive a corresponding retaining tab of another corrugated paper container having the same design as the corrugated paper container 110 (e.g. tab 118 of the container 112 of FIG. 1). The slot 114 includes an entry portion 115 and a retaining portion 117. The entry portion 115 is wider than the retaining portion 117. The entry portion 115 in this embodiment has a width approximately equal to that of the head portion 150. The retention portion 117 has a width that is smaller than that of the head portion, but closer in size to the width of the body portion 148. In this way, the head of a retaining tab (e.g. tab 118) of FIG. 1 may be fed into the entry portion 115, but retained by the retention portion 117.

As discussed above in connection with FIG. 1, the second side 128 includes the opening/void 124 through which wound media wound media may be fed. The feed-through opening 124 has an area sufficient to allow the internal media to be fed therethrough.

Moreover, as will be discussed below in further detail, the corrugated paper container 110 preferably includes a second retaining tab 154 and corresponding vertically displaced second slot 156, both shown in FIG. 2B. The second retaining tab 154 and the second slot 156 are disposed on the sixth side 140, which is the side opposite the first side 116. The second slot 156 preferably has the same physical construction as the first slot 114. Similarly, the second retaining tab 154 preferably has the same physical construction and features as the first retaining tab 132. The second retaining tab 154 and/or second slot 156 allow connection to a vertically adjacent container in an analogous manner as the first retaining tab 132 and the slot 114. For example, in the configuration shown in FIG. 1, the second slot 156, not visible in the view of FIG. 1, receives a second retaining tab of the second corrugated container 112, also not visible in FIG. 1, to provide a two-sided connection between the first corrugated container 110 and the second corrugated container 112.

It will be appreciated that the retaining tabs 132, 154 and slots 114, 156 are disposed on a portion of their corresponding sides 116, 140 that is distant from the edges 116*a*, 140*a* that couple those sides 116, 140 to the second side 128 on which the opening 124 is located. In other words, if the second side 128 on which the opening 124 is located is considered to be the "front" of the container 110, then the retaining tabs 132, 154 and slots 114, 156 are disposed closer to the "rear" of the container 110. Such positioning assists in the retention of the containers when stacked, and when media is drawn therefrom.

Figure 4:
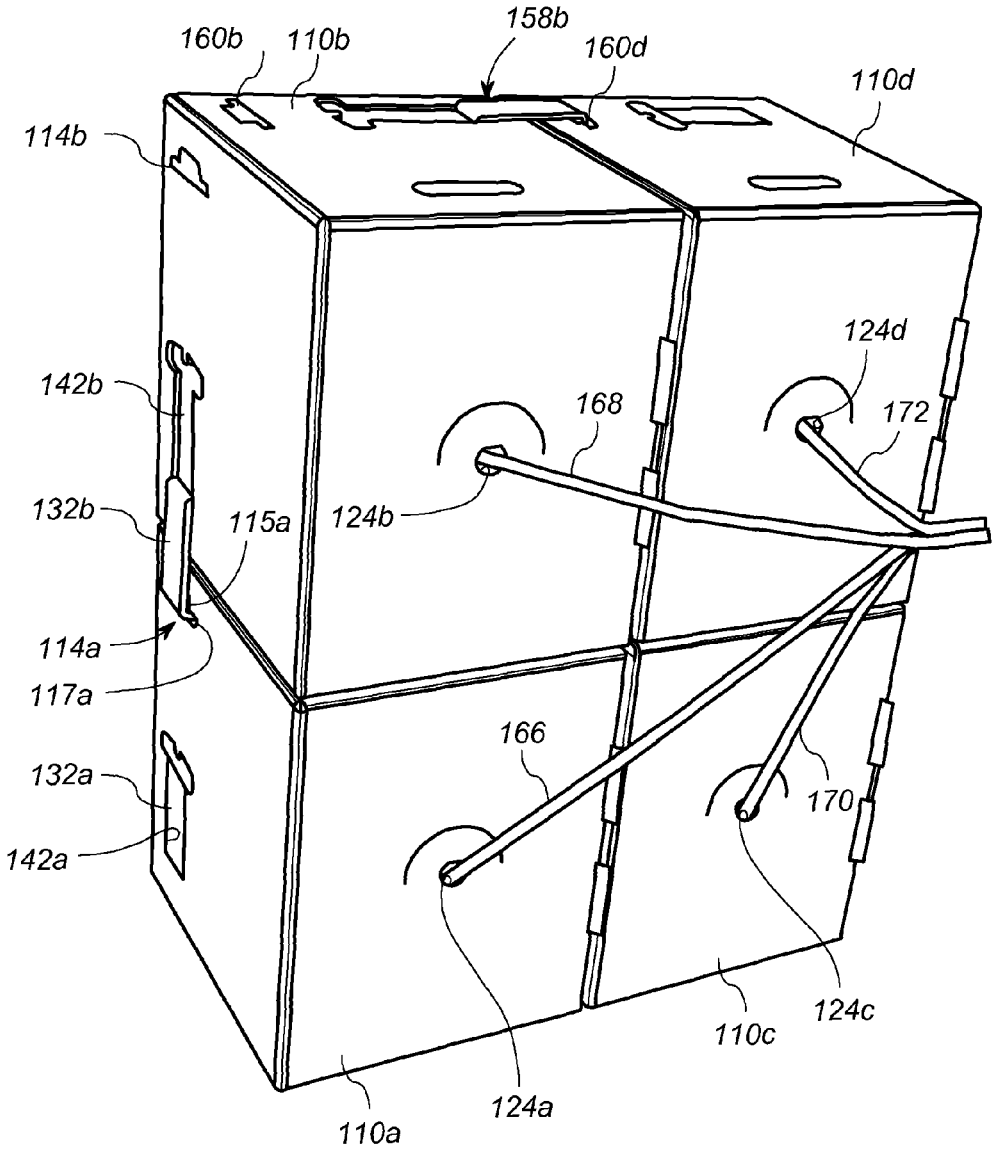
FIG. 4 shows a plan view of another set of stacked corrugated paper containers in use for paying out cabling.

In this embodiment, the corrugated container 110 further includes a third retaining tab 158, and a corresponding third vertically displaced slot 160 to facilitate connection to another container that is displaced horizontally adjacent to the corrugated container 110. In particular, it is often advantageous to not only stack two or more corrugated containers vertically, such as shown in FIG. 1, but also to stack such containers horizontally to form a wall-like arrangement such as is shown in FIG. 4. In particular, the third retaining tab 158 is intended to couple to a slot, not shown, of another container disposed adjacent to the sixth side 140, while the third slot 160 is configured to receive a retaining tab of a container disposed adjacent to the first side 116. The third retaining tab 158 preferably has the same construction and a similar shape as that of the first retaining tab 132, but is disposed on a third side 134 of the corrugated paper container 110. The third slot 160 has a structure that is analogous to that of the slot 114.

Moreover, to provide balanced and complementary coupling the corrugated container 110 in this embodiment further includes a fourth retaining tab, not shown, and corresponding vertically spaced slot, not shown, on the fourth side 136 of the container 110. In particular, the fourth retaining tab is intended to couple to a slot, not shown, of another container disposed adjacent to the sixth side, while the fourth slot is configured to receive a retaining tab of a container disposed adjacent to the first side 116. The fourth retaining tab preferably has the same construction and a similar shape as that of the first retaining tab, but is disposed on fourth side 136 of the corrugated paper container 110. The fourth slot has a structure that is analogous to that of the slot 114.

The second corrugated container 112 of FIG. 1 preferably has the same structure as the first corrugated paper container 110. As will become apparent below, multiple containers having the structure of the first corrugated paper container 110 may be stacked and interlocked to provide a convenient and strong structure from which multiple cables may be paid out.

As discussed above, the corrugated paper containers 110 and 112 may be formed from a corrugated paper blank. For example, FIG. 3 shows a corrugated paper blank 300 that may be used to form the first corrugated container 110 of FIG. 2. The blank 300 is preferably die-cut to shape, and pre-creased to facilitate folding of the blank 300 into the container 110. In FIG. 3, the reference numbers of the corrugated paper container 110 are used to indicate the corresponding structures of the blank.

The crease lines 302 represent pre-creased borders between structures such as the sides 116, 128, 134, 136, 138 and 140. The perforation lines 304 indicate pre-cut sets of perforations that are used to make structures that may be separate (at least in part) by the user. Any suitable method of perforating for the purpose of creating user removable structures may be employed. As also shown in FIG. 3, the blank 300 includes a number of reinforcing tabs 306 that couple beneath corresponding sides 116, 128, 134, 136, 138 and 140. In the embodiment of FIG. 3, the fifth side 138 is formed of several foldable tabs in a conventional, known manner.

To construct the container 110, the blank is folded along the crease lines 302 in a known manner to form the box like structure of FIGS. 1, 2A and 2B. Adhesive may be used as desired to secure the tabs 306 to the sides 116, 128, 134, 136, 138 and 140.

After the container 110 and others like it are assembled, they may be outfitted with wound media such as electrical cable. In some cases, a reel of wound cable, or a quantity of coiled cable, not shown, is inserted into a finished container through an open end, such as the unassembled fifth side 138. In other embodiment, the container 110 itself is assembled around the cable reel, or reel coil.

After the container 110 and others like it are outfitted with cable, multiple containers of the design of the container 110 may then be used at the installation site to pay out and install multiple cables.

Discussion of the use of the completed container and assembly of multiple containers into vertically and horizontally interconnected groups is made in reference to FIG. 4. Referring to FIG. 4, the user is provided with multiple containers having the structure of the first corrugated paper container 110 containing wound media. For example, as shown in FIG. 4, the user is provided with the four corrugated paper containers 110*a*, 110*b*, 110*c*, 110*d*, all having the structure of the corrugated paper container 110 of FIG. 2. As shown in FIG. 4, the first container 110*a* houses a first length of cable 166, the second container 110*b* houses a second length of cable 168, the third container 110*c* houses a third length of cable 170, and the fourth container 110*d* houses a fourth length of cable 172.

In order to allow for simultaneous payout of the cables 166, 168, 170 and 172, the user stacks the containers 110*a*-110*d* such that the second container 110*b* is atop (vertically adjacent to) the first container 110*a*, and the fourth container 110*d* is atop (vertically adjacent to) the third container 110*c*. The first container 110*a* and the third container 110*c* are horizontally adjacent. Similarly, the second container 110*b* and the fourth container 110*d* are horizontally adjacent. It will be appreciated that the containers 110*a*-110*d* may be stacked differently, and that more or fewer similar containers may be stacked to heights of three or more, and or three or more horizontally adjacent.

Referring again to the exemplary configuration of FIG. 4, after stacking the first and second containers 110*a*, 110*b*, the user interconnects the first and second containers 110*a*, 110*b* using the retaining tabs and slots. The user also interconnects the first and third containers 110*a*, 110*c* using the retaining tabs and slots, and interconnects the second and fourth containers 110*b*, 110*d* in the same manner.

To perform the interconnection of the first container 110*a* and the second container 110*c*, the user first pulls the head portion (not shown) of the retaining tab 132*b* of the second container 110*b* by inserting a finger or tool in the access cutout (analogous to access cutout 143 of FIGS. 2*a*, 2*b*, and 3) of the retaining tab 132*b* originally. To this end, it will be appreciated that the retaining tab 132*b* is originally disposed, connected by the perforation connections, within the void 142*b*. While the retaining tab 132*b* is shown already removed from the void 142*b* in FIG. 4, it will be appreciated that prior to removal, the retaining tab 132*b* has the appearance of the retaining tab 132*a* in FIG. 4.

The user thereafter inserts the head portion of the retaining tab 132*b* (not visible but analogous to head portion 150 of FIGS. 2*a* and 3) through the entry slot 117*a* of the first container 110*a*. Placement of the head portion may require some slight compression of the two containers 110*a*, 110*b*. When the head portion of the retaining tab 132*b* is fully through the entry slot 117*a*, the compression is released and body portion 148*b* of the retaining tab 132*b* moves into the retention slot 115*a* of the first container 110*a*. In that position, the tabs of the head portion (analogous to the tabs 176 and 178 of FIGS. 2*a* and 3) serve to prevent the head portion from de-inserting through the slot 115*a*. FIG. 4 shows the tab retaining 132*b* inserted fully within the slot 114*a* as the retaining tab 132*b* would appear after insertion.

The above-described process is then repeated to insert the retaining tab, not shown, on the opposite side of the second container 110*b* into the slot, not shown, on the opposite side of the first container 110*a*. In that position, the first container 110*a* and the second container 110*b* are securely interconnected. The third and fourth containers 110*c* and 110*d* may be interconnected in the same way. Moreover, the same process is used to insert the tab 158*b* of the second container 110*b* into the slot 160*d* of the fourth container 110*d*. The same processes may be used to connect a tab, not shown, on the first container 110*a* (similar to 158 of FIG. 2*a*) to a corresponding slot, not shown, of the third container 110*c*. These horizontal connections further strengthen the 2×2 structure of containers 110*a*, 110*b*, 110*c* and 110*d*.

The cables 166, 168, 170 and 172 may then be paid out simultaneously through the respective openings 124*a*, 124*b*, 124*c* and 124*d*.

Another embodiment of the exemplary embodiment described herein is that the payout boxes may be non-destructively disconnected for subsequent use. In particular, for example, the tab 132*b* may be removed from the slot 114*a* by compressing the containers 110*a*, 110*b* to allow the use to fit the head portion through entry slot 117*a*. When the other retaining tabs are removed in a similar manner, the corrugated paper containers 110*a*-110*d* are all disconnected and can be readily moved or reused. In addition, the retaining tabs (e.g. retaining tab 132*b*) may be replaced into their corresponding voids (e.g. void 142*b*).

It will be appreciated that the above-describe embodiments are merely exemplary, and that those of ordinary skill in the art may readily devise their own implementations and adaptations that incorporate the principles of the present invention and fall within the spirit and scope thereof. For example, the exact location of the retaining tabs and slots on the container 110 may vary. For example, the second retaining tab 154 need not be in the same position opposite the first retaining tab 132. However, it is advantageous if that the tabs and corresponding slots are vertically aligned with (and spaced apart from) one another. Such alignment allows for predictable alignment of the containers when they are stacked and interconnected. In another example, the shape of the body portion 148 and head portion 150 need not be as shown, as long as a head portion 150 extends to a greater width than an area near the second end 152 of the body portion 148. The exact size and shape of the container 110 will also be a design variant. Other design variations will become readily apparent to those of ordinary skill in the art.

We claim:

1. A corrugated paper container comprising, a plurality of sides integrally formed from a corrugated paper blank;

a retaining tab formed from a first side such that the first side includes a void having a shape substantially the same as a shape of the retaining tab;

a slot aligned with and spaced from the retaining tab, the slot configured to receive a corresponding retaining tab of another corrugated paper container, the slot defined in and surrounded by an external surface of the first side, wherein the retaining tab includes a body portion and a head portion, the body portion having a first end attached to the first side, and the head portion is attached at a second end of the body portion; and wherein the width of the head portion exceeds a width of the slot.

2. The corrugated paper container of claim 1, further comprising a second void through which wound media is fed.

3. The corrugated paper container of claim 2, wherein the second void is disposed on a second side of the plurality of sides.

4. The corrugated paper container of claim 3, wherein the second void has an area that is configured for paying out cable.

5. The corrugated paper container of claim 4, further comprising a second retaining tab defined on a third side of the plurality of sides; and a second slot aligned with and spaced from the second retaining tab.

6. A container system, comprising:

a first corrugated paper container having a slot formed in a first side of the corrugated paper container;

a second corrugated paper container disposed vertically adjacent to the first corrugated paper container, the second corrugated paper container having a retaining tab formed from a side of the second corrugated paper container, the retaining tab extending into the slot of the first container so as to couple the first corrugated paper container to the second corrugated paper container, wherein the first corrugated paper container contains first wound media, and the second corrugated paper container contains second wound media.

7. The container system of claim 6, wherein the first corrugated paper container contains a void through which the first wound media is fed.

8. A container system, comprising:

a first corrugated paper container having a slot formed in a first side of the corrugated paper container;

a second corrugated paper container disposed vertically adjacent to the first corrugated paper container, the second corrugated paper container having a retaining tab formed from a side of the second corrugated paper container, the retaining tab extending into the slot of the first container so as to couple the first corrugated paper container to the second corrugated paper container, wherein the retaining tab extends at least in part along the first side of the second container.

* * * * *